US005316030A

United States Patent [19]

Shimizu et al.

[11] Patent Number: 5,316,030

[45] Date of Patent: May 31, 1994

[54] CONTAINER FLUSHER

[75] Inventors: Katsumi Shimizu, Honjo; Kazumi Maruoka, Saitama; Kiyoshi Yamagishi, Kumagaya, all of Japan

[73] Assignee: Eisai Co., Ltd., Tokyo, Japan

[21] Appl. No.: 947,454

[22] Filed: Sep. 21, 1992

[30] Foreign Application Priority Data

Oct. 9, 1991 [JP] Japan ..... 3-290835

[51] Int. Cl.[5] ..... B08B 3/12; B08B 3/10

[52] U.S. Cl. ..... 134/105; 134/126; 134/130; 134/131; 134/147; 134/158; 134/161

[58] Field of Search ..... 134/70, 73, 74, 79, 134/82, 83, 125, 126, 127, 130, 131, 80, 105, 147, 158, 161; 198/384, 416

[56] References Cited

U.S. PATENT DOCUMENTS

| | | | |
|---|---|---|---|
| 2,494,864 | 1/1950 | Erickson | 134/126 X |
| 2,811,163 | 10/1957 | Weber et al. | 134/70 |
| 2,910,992 | 11/1959 | Wilcox | 134/127 X |
| 3,090,392 | 5/1963 | Libby | 134/125 |
| 3,302,655 | 2/1967 | Sasaki et al. | 134/152 X |
| 3,572,490 | 3/1971 | Babunovic | 198/416 X |
| 3,618,743 | 11/1971 | Benatar et al. | 198/416 X |

FOREIGN PATENT DOCUMENTS

| | | | |
|---|---|---|---|
| 3001986 | 7/1981 | Fed. Rep. of Germany | 134/73 |
| 2366215 | 6/1978 | France | 134/125 |

*Primary Examiner*—Philip R. Coe

*Attorney, Agent, or Firm*—Griffin Butler Whisenhunt & Kurtossy

[57] ABSTRACT

A container is held between a conveyor and guide means provided around the conveyor and the guide means come in frictional contact with the container to rotate the container around its own axis as the conveyor runs in its circumferential path. The conveyor is partially water-immersed within a water tank and the container being rotated by cooperation of the conveyor and the guide means within the water tank is applied on its side wall with ultrasonic waves from ultrasonic vibrators serving to flush the container.

The conveyor is provided on its outer peripheral surface with fin-like projections vertically extending and circumferentially spaced from one another at regular intervals and there are provided around the conveyor upper rails, sloped rails and lower rails serving to support the bottom of the container. There may be provided guide means associated with the respective rails. Only the lower rails are immersed in water.

There may be provided above the conveyor a nozzle serving to fill the container with flushing liquid such as water and there may be provided a heater below the water tank to enhance a flushing effect.

11 Claims, 8 Drawing Sheets

CONTAINER FLUSHER

BACKGROUND OF THE INVENTION

This invention relates to a flusher for containers such as ampoule, vial and bottle.

FIG. 9 of the attached drawings shows a typical container flusher of prior art. At an inlet end of a conveyor 61, a container 62 to be flushed is fed and placed, in a standing posture, on the conveyor 61 which conveys, in turn, the container into a water tank 63. In the course of such conveyance, the container is filled with water injected from above through a nozzle 64. Then the container 62 is transferred at an outlet end of the conveyor from the conveyor onto a carrying plate 65 to achieve a flushing effect. Upon completion of flushing, the container 62 is transferred by a lift conveyor 67 onto a conveyor 68 serving to convey the container 62 to a subsequent process.

However, the above-mentioned flusher of prior art has encountered various problems as will be described.

Ultrasonic waves are applied to a predetermined number of containers which are moving randomly while conveyed in a group. Therefore, not only a time for which the individual containers are applied with the ultrasonic waves is uneven but also an amount of the ultrasonic waves applied to a side wall or a bottom wall of individual container is uneven, resulting in uneven flushing.

The carrying plate 65 interposed between the container 62 and the ultrasonic vibrator 66 inevitably attenuates the ultrasonic waves and reduces a flushing efficiency.

Finally, the container 62 is applied with the ultrasonic waves from its bottom and consequently its lower portion is exposed to the ultrasonic waves more intense than the ultrasonic waves to which the upper portion of the container 62 is exposed. Thus glass exfoliation due to the ultrasonic wave often occurs in the lower portion of the container.

SUMMARY OF THE INVENTION

Accordingly, it is a principal object of the invention to provide means allowing each container to be efficiently and evenly flushed by evenly applying ultrasonic waves onto a side wall of the container for a predetermined period of time.

The object set forth above is achieved, in accordance with the invention, by a container flusher comprising a conveyor adapted to convey the container along a circumferential path, guide means extending around said conveyor and frictionally contacting the side wall of said container so as to rotate said container around its own axis as the container is conveyed, a water tank within which the conveyor is at least partially water-immersed, and ultrasonic vibrators adapted to apply ultrasonic waves to the side wall of the container being rotated around its own axis by cooperation of said conveyor and said guide means within said water tank.

Preferably, the conveyor is provided on its outer peripheral surface with fin-like projections vertically extending and circumferentially spaced from one another at regular intervals; upper rails, sloped rails and lower rails extending around the conveyor so as to support the bottom of the container being conveyed; and guides associated with the respective rails.

If desired, there may be provided above the conveyor a nozzle used to fill the container with flushing water so that the container is immersed into the water tank for the application of ultrasonic waves. In addition, there may be provided a heater below the water tank which heats the flushing water to enhance a flushing effect.

The flusher of this invention allows the ultrasonic waves, whose output is controlled so as not to damage the glass of the container, to be applied onto the side wall of each container for a predetermined period of time as the container is rotated around its own axis under a frictional contact with the guides, so as to achieve an even flushing of the entire container and thereby to maintain an even quality.

Application of the ultrasonic waves taking place directly onto the container assures an efficient flushing process.

BRIEF DESCRIPTION OF THE DRAWINGS

The above and other object of the invention will be seen by reference to the description taken in connection with the accompanying drawings, in which:

FIG. 3(*b*) is a side view showing a relationship between the upper rail 22 and the lower rail 24 in an alternative embodiment with respect to the embodiment shown by FIG. 3(*a*);

DETAILED DESCRIPTION OF THE INVENTION

The invention will be described by way of example in reference with the accompanying drawings.

Although the invention will be described first with respect to the ampoule as an example of the sealed container, it should be understood here that the invention is not limited to this and applicable also to containers of the other various types such as vial, bottle and phial so far as they have substantially circular or elliptical cross-sections.

Figure 1:
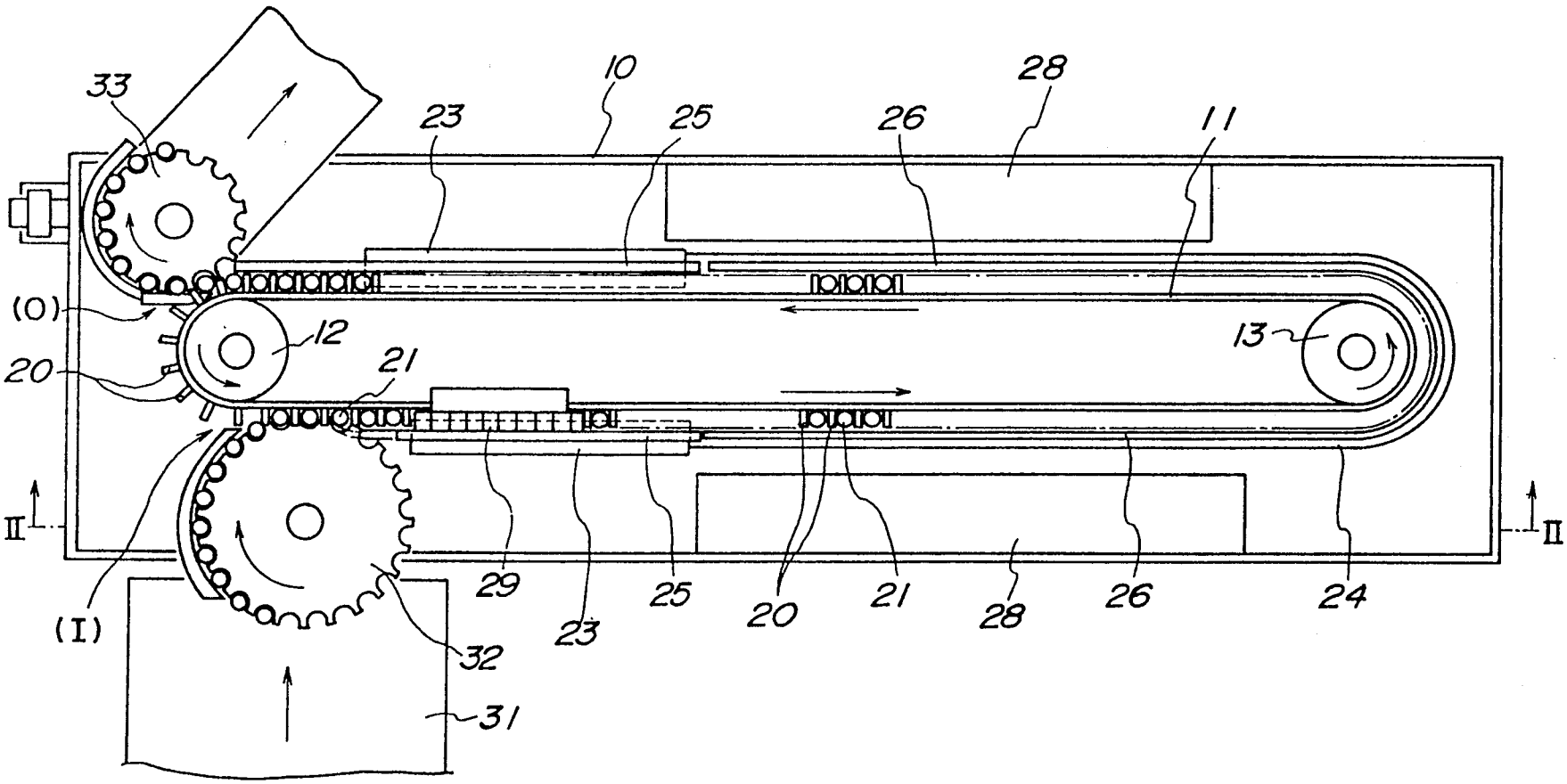
FIG. 1 is a plan view showing an embodiment of an ampoule flusher 50 constructed according to the invention.
Figure 2:
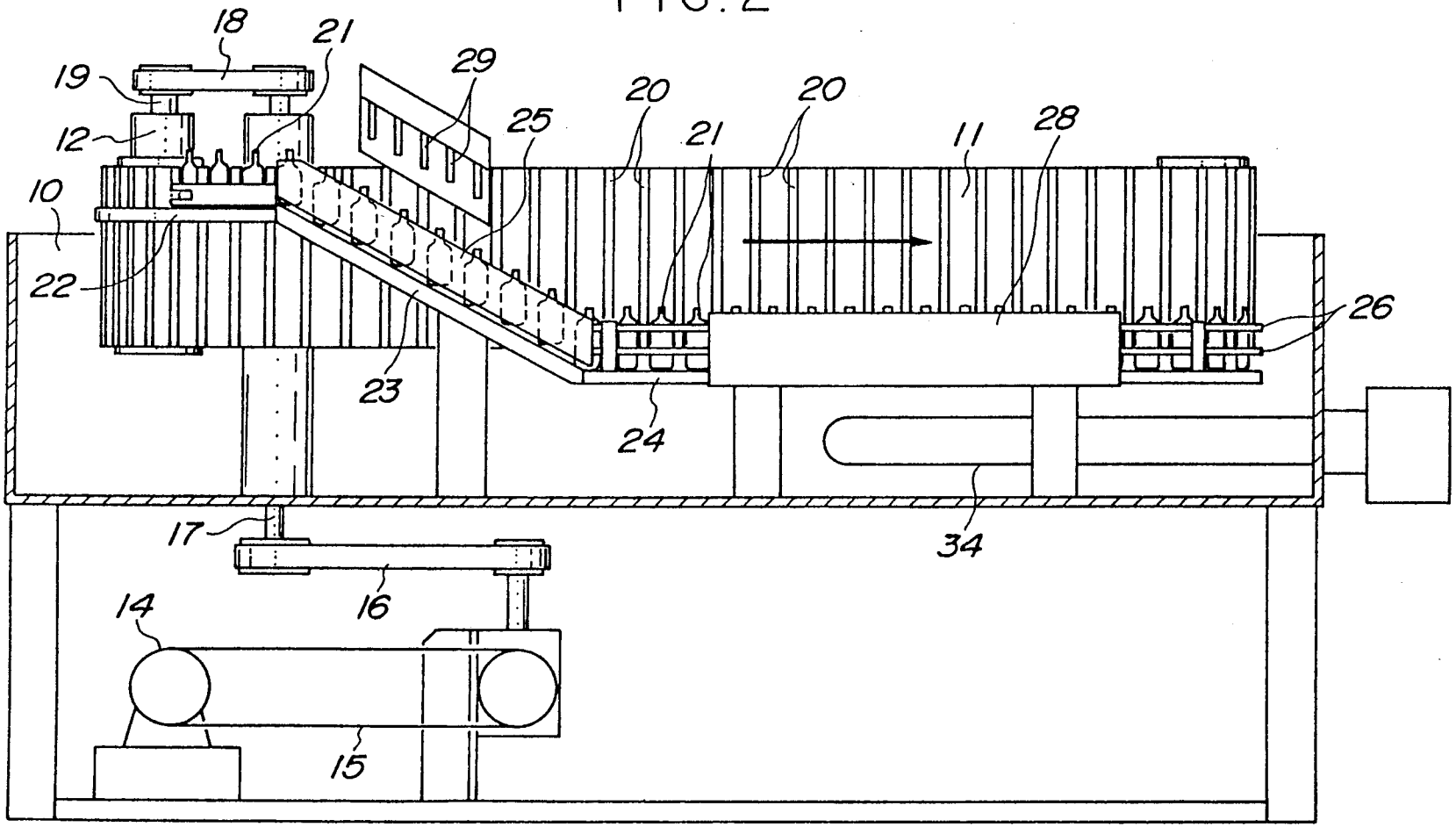
FIG. 2 is a side view showing the flusher 50 partially in a section taken along a line II—II in FIG. 1.

FIG. 1 is a plan view of the ampoule flusher 50 (see FIG. 6) and FIG. 2 is a side view including a sectional view taken along a line II—II in FIG. 1.

Referring to these figures, the flusher 50 of the invention will be described in detail. A conveyor 11 of a relatively large width is draped around parts of respective timing pulleys 12, 13 within a water tank 10 and driven by the timing pulley 12 so as to be moved in a circumferential path counterclockwise (i.e., in the direction as indicated by an arrow in FIG. 1). Referring to FIG. 1, reference symbol (I) designates an inlet end and reference symbol (O) designates an outlet end of the conveyor 11.

As will be apparent from FIG. 2, rotation of an electric motor 14 provided below the water tank 10 is transmitted via belts 15, 16 to an output shaft 17, on one side, and via a belt 18 to a drive shaft 19 of the timing pulley 12.

The conveyor 11 is provided on the outer peripheral surface thereof with fin-like projections 20 extending vertically and laterally spaced from one another at regular intervals so that an ampoule 21 is held between each pair of adjacent projections 20, 20 and the ampoule 21 is conveyed in the direction as indicated by the arrow in FIGS. 1 and 2 as the conveyor 11 runs in the circumferential path.

Figure 3A:
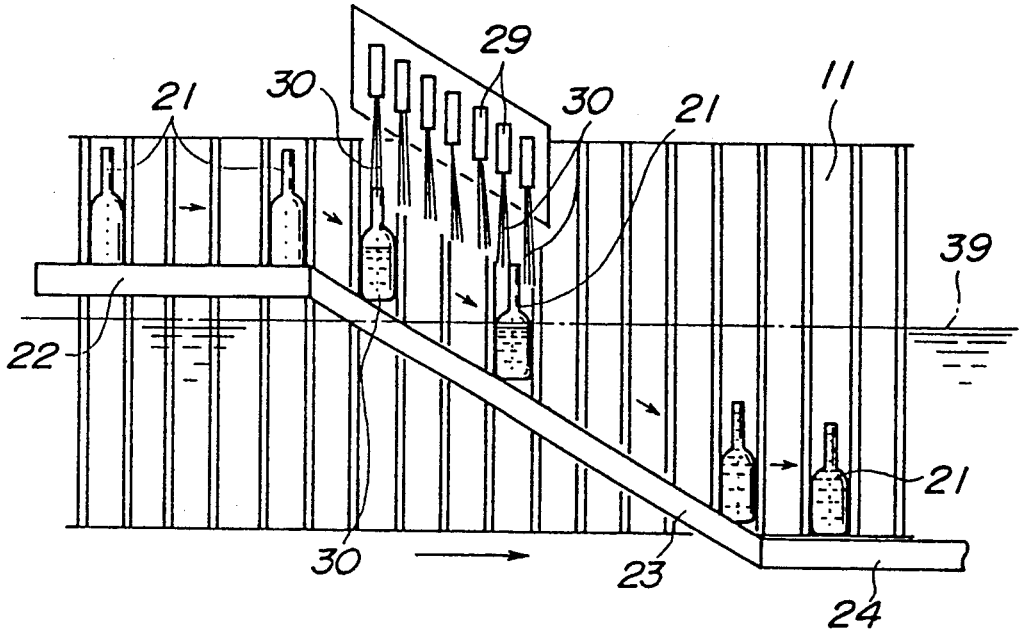
FIG. 3(*a*) is a side view showing a relationship of the upper rail 22, the sloped rail 23 and the lower rail 24.
Figure 3B:
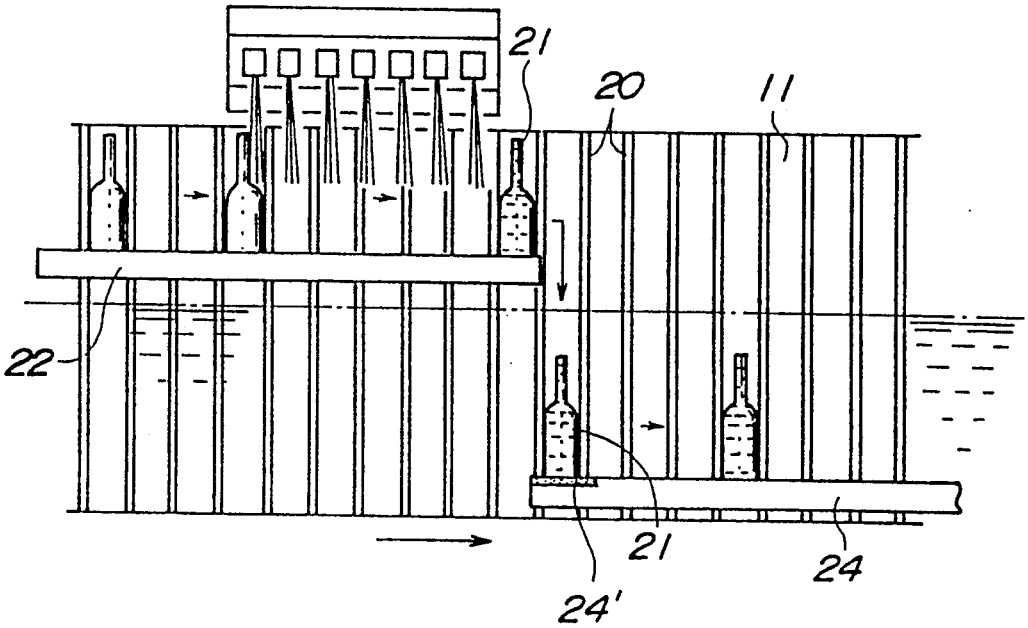

Around the conveyor 11, there are provided upper rails 22, sloped rails 23 and lower rails 24 so that the ampoule 21 has its bottom supported by these rails 22, 23, 24, as the ampoule 21 is conveyed. Referring to FIG. 3(*a*), the upper rails extend at a relatively high level so as to be associated with the upper portion of the conveyor 11 and thereby to support the ampoule 21 above the water surface 39 while the lower rails extend at a relatively low level so as to be associated with the lower portion of the conveyor 11 and thereby to support ampoule 21 below the water surface 39. The sloped rails 23 serve to vary a position of the ampoule 21 gradually downward or upward between the respective upper rails 22 and the respective lower rails 24 as the conveyor 11 runs in its circumferential path. Configuration of the sloped rails 23 is not critical and may be non-linear.

There are provided along the outside of the conveyor 11 guides 25, 26 of which the former serves to hold the ampoule 21 supported by the upper rails 22 or the sloped rails 23 between each pair of the adjacent projections 20, 20 provided on the outer peripheral surface of the conveyor 11 and the latter serves to hold the ampoule 21 supported by the lower rails 24 between each pair of the adjacent projections 20, 20 provided on the outer peripheral surface of the conveyor 11.

Figure 4:
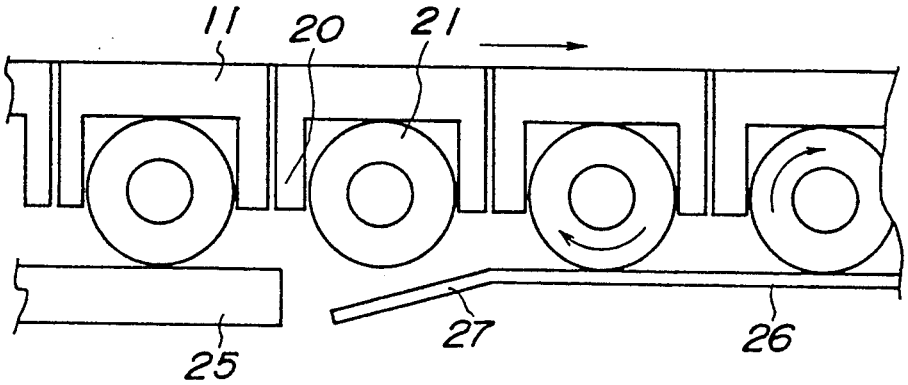
FIG. 4 is a plan view showing a relationship between the guide 25 and an inlet end 27 of the adjacent guide 26.

Now referring to FIG. 4, an inlet end 27 of the guide 26 is slightly curved outward in order that the ampoule 21 can be smoothly transferred from the guide 25 to the guide 26. As will be seen in FIG. 5, the guide 26 is brought in a frictional contact with the side wall of the ampoule 21 so that the ampoule 21 is rotated thereby around its own axis as the conveyor 11 runs in its circumferential path.

Referring again to FIGS. 1 and 2, there are provided a pair of ultrasonic vibrators 28 within the water tank 10 on both sides of the conveyor 11 so that the ampoule 21 which is held between the conveyor 11 and the guide 25, and as being conveyed, may have its side wall applied with ultrasonic waves and thereby may be flushed.

For a non-sealed container, there may be provided a nozzle 29 at the inlet end (I) of the conveyor 11 immediately above the sloped rail 23 and the container moving downward may be filled with flushing water 30 injected from the nozzle 29 as the conveyor 11 runs in its circumferential path as shown by FIG. 3(*a*).

Alternatively, the sloped rails 23 may be eliminated as in the embodiment shown by FIG. 3(*b*) in which the upper rails 22 are arranged to be associated with the upper portion of the conveyor 11 and thereby to support the ampoule 21 above the water surface 39 while the lower rails 24 are arranged to be associated with the lower portion of the conveyor 11 and thereby to support the ampoule 21 below the water surface 39. In this embodiment, the ampoule 21 vertically falls between each pair of the adjacent projections 20, 20 formed on the outer peripheral surface of the conveyor 11 when the ampoule 21 is transferred from the upper rail 22 to the lower rail 24. In this alternative embodiment, while water itself in the water tank has a shock-absorbing function, a location of the lower rail 24 onto which the ampoule 21 falls is provided in case with a shock-absorbing member 24' made of rubber or the like.

Referring again to FIG. 1, there is provided adjacent the inlet end (I) of the conveyor 11 a star wheel 32 serving to transfer the ampoule 21 received from a feeder unit 31 onto the conveyor 11 of the flusher and there is provided adjacent the outlet end (O) of the conveyor 11 a star wheel 33 serving to feed the ampoule 21 received from the conveyor 11 of the flusher to the subsequent process. Referring to FIG. 2, there is provided below the water tank 10 a heater 34 serving to maintain a water temperature within the water tank 10 about at 50° C. and thereby to enhance the flushing effect.

Figure 6:
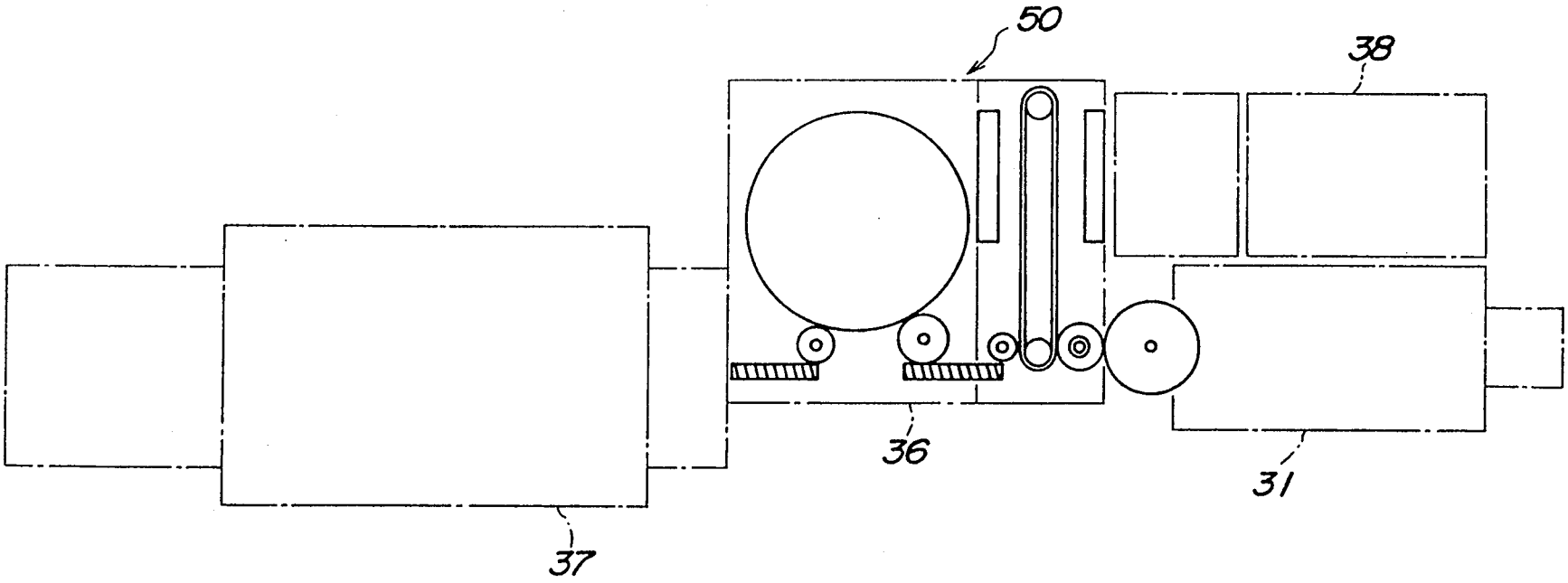
FIG. 6 is a diagram showing the flusher 50 of the invention arranged in association with relevant peripheral apparatuses.

The flusher of the invention having an arrangement as has been described above may be located, for example, as shown by FIG. 6 and various units such as the feeder unit 31, a jet flusher unit 36, a sterilizing dryer unit 37 and a water supply unit 38 in order to achieve efficient flushing of the container such as the ampoule.

The flusher 50 of the invention operates in a manner as will be described. Referring to FIG. 1, the ampoules 21 delivered from the feeder unit 31 to the star wheel 32 is fed at the inlet end (I) of the conveyor 11 into spaces defined between respective pairs of the adjacent projections 20, 20 formed on the outer peripheral surface of the conveyor 11. The ampoules 21 now supported by the upper rail 22 are conveyed in a line at a predetermined velocity in the direction as indicated by the arrow as the conveyor 11 runs in its circumferential path. After transferred from the upper rail 22 onto the sloped rail 23, these ampoules 21 are now conveyed by the conveyor 11 gradually downward toward the lower rail 24, as shown by FIG. 3(*a*). With the arrangement having no sloped rail 23, the ampoules 21 abruptly fall onto the lower rail 24, as shown by FIG. 3(*b*).

For the non-sealed container 21, the container 21 is filled with water 30 injected from the nozzle 29 provided thereabove when the container 21 is either on the upper rail 22 or being conveyed along the sloped rail 23. With the arrangement having no sloped rail 23, the nozzle 29 is provided above the upper rail 22 as shown by FIG. 3(*b*).

The container 21 filled with water 30 is immersed in water further below the water surface 39 and perfectly immersed into the water tank 10 as the container 21 reaches the lower rail 24 as shown by FIG. 3(*a*), 3(*b*).

Figure 5:
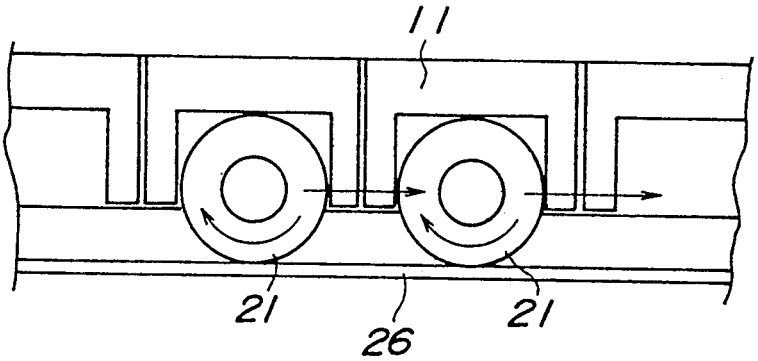
FIG. 5 is a plan view showing a manner in which the guide 26 is brought in a frictional contact with the side wall of the container.

After transferred onto the lower rail 24, the container 21 is held in the space defined between each pair of the adjacent projections 20, 20 formed on the outer peripheral surface of the conveyor 11 with the help of the guide 26, as shown by FIG. 5. In this state, the guide 26 comes in a frictional contact with the side wall of the container 21 and, under the effect of friction, the container 21 begins to be rotated around its own axis as the conveyor 11 runs. The side wall of the container 21 being conveyed is applied with the ultrasonic waves from a pair of the ultrasonic vibrators 28 provided on both sides of the conveyor 11, respectively. In this way, the container 21 being conveyed by the conveyor 11 and simultaneously rotated around its own axis under the frictional contact with the guide 26 can be evenly applied with the ultrasonic waves and thereby can be subjected to the efficient ultrasonic flushing. Furthermore, the ultrasonic flushing can be optimized for a particular size of the container to be flushed merely by adjusting a distance between the container 21 and the ultrasonic vibrators 28. Also, no damage to the container will occur by controlling the time and output of the application of ultrasonic waves when the container 21 are conveyed in a line at a predetermined velocity and applied onto their side walls with the ultrasonic waves for a predetermined period of time.

The container 21 which has been thus adequately flushed is further conveyed by the conveyor 11, then transferred onto the sloped rail 23 provided on the opposite side and delivered to the star wheel 33 at the outlet end (O) of the conveyor 11.

Finally, the container 21 is transferred to the subsequent process such as the jet flusher unit 36 or the sterilizing dryer unit 37. For the sealed container, the nozzle used to fill the container with water or other liquid may be eliminated because the sealed container sinks under water by its own weight.

Figure 7:
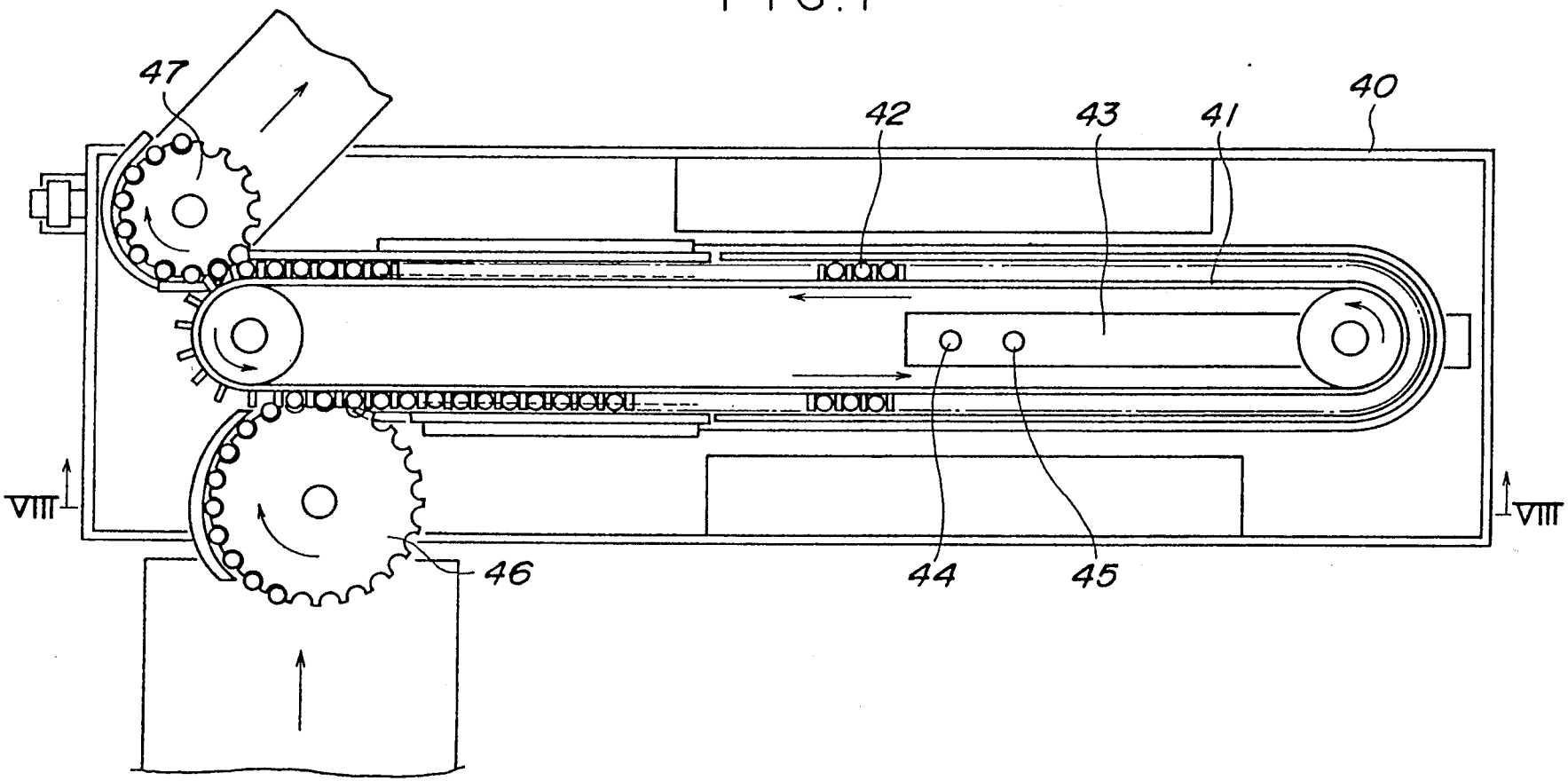
FIG. 7 is a plan view of a cooler derived from the flusher of the invention.
Figure 8:
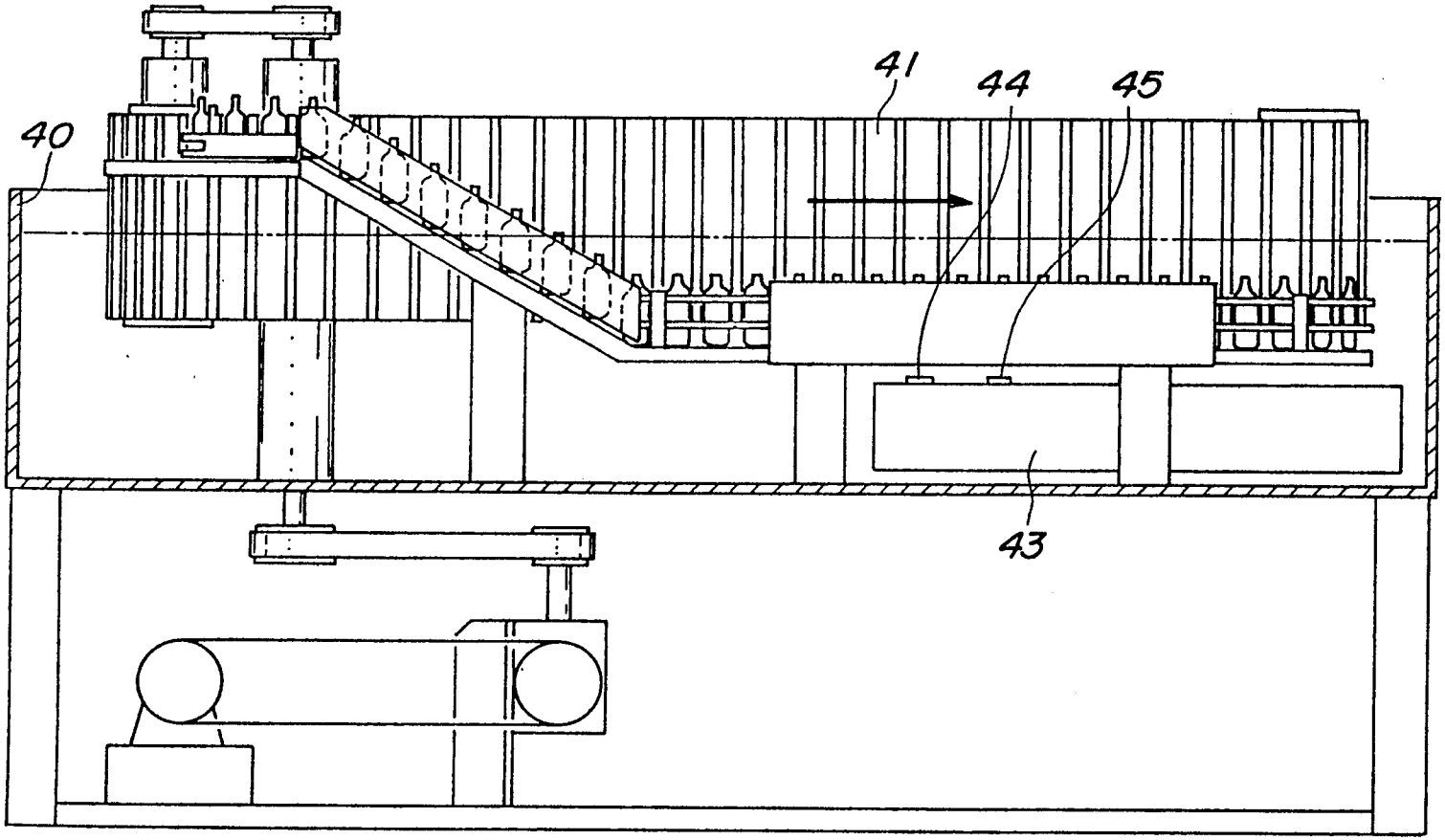
FIG. 8 is a side view partially in a section taken along a line VII—VII in FIG. 7.
Figure 9:
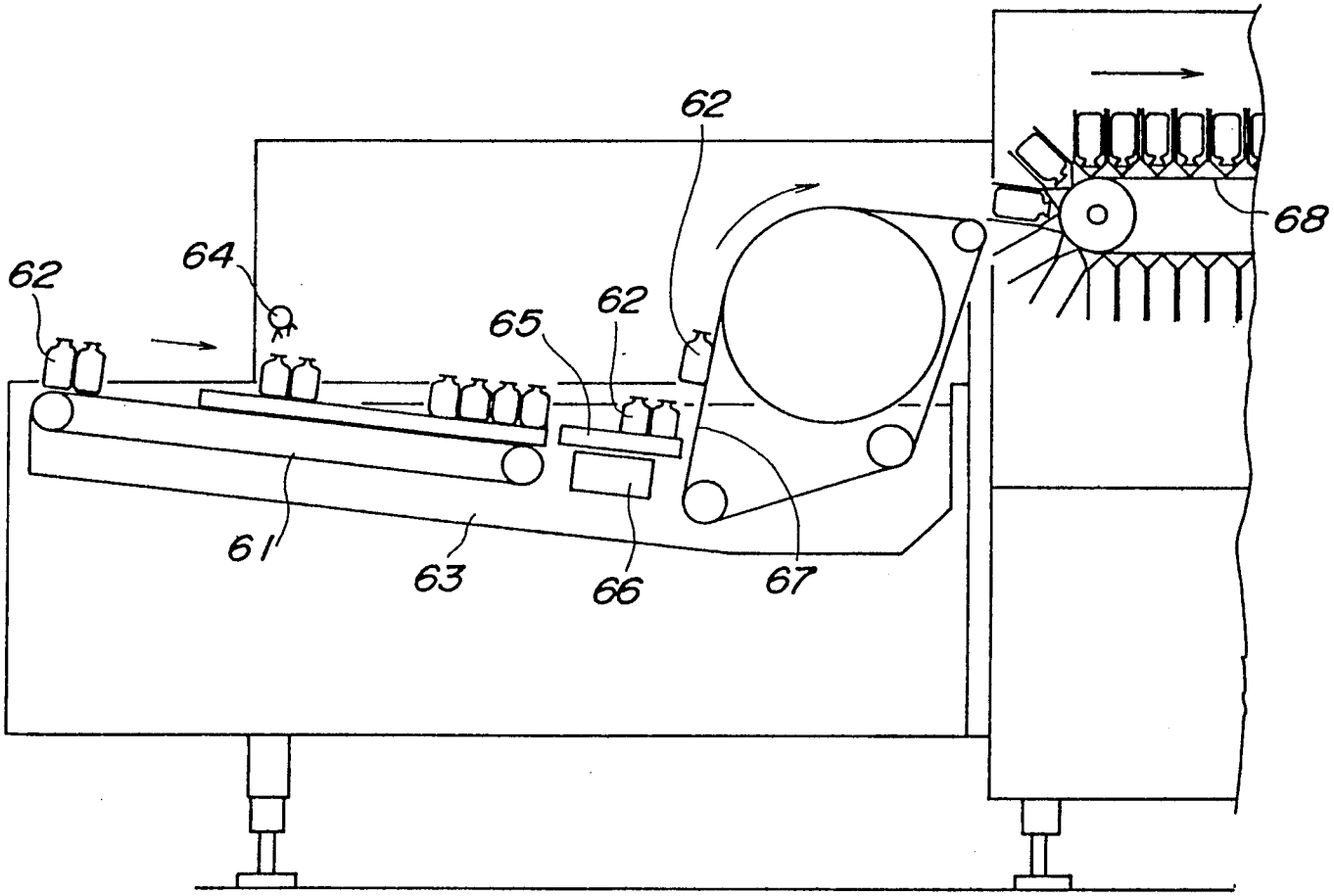
FIG. 9 is a diagram schematically showing a flusher of prior art.

A variant shown by FIGS. 7 and 8 is a cooler, a requirement for sealed containers which have been heat-sterilized in an autoclave or an auto-sterilizer, to cool the containers during the conveyance to next stage.

FIG. 7 is a plan view showing a cooler for a sealed container 42, which comprises components similar to those of the previously mentioned flusher of the invention, i.e., the components such as a water tank 40 and a conveyor 41. FIG. 8 is a side view including a sectional view taken along a line VII—VII. Within the water tank 40, there is provided a cooling unit 43 having an outlet 44 and an inlet 45 for cooling water. The sealed container 42 has previously been filled with liquid and can sink under water within the water tank 40 as the conveyor 41 runs without a nozzle adapted to fill the container with water or other liquid.

With such cooler, the sealed container 42 transferred from a feed star wheel 46 onto the conveyor 41 sinks into the water tank 40 as the conveyor 41 runs and, during conveyance, the sealed container 42 and the quantity of liquid contained therein are cooled by cooling water discharged from the cooling unit 43. The sealed container 42 thus cooled is delivered from the conveyor 41 to a discharging star wheel 47 which, in turn, delivers the container 42 to the subsequent process.

Furthermore, adding ultrasonic vibrators, which apply ultrasonic waves to the side wall of the container, to this cooler makes it possible to flush the outside of containers while cooling them.

While the invention has been particularly shown and described with reference to preferred embodiment thereof, it will be understood by those skilled in the art that the foregoing and other changes in form and details can be made therein without departing from the spirit and scope of the invention.

What is claimed is:

1. A container flusher comprising:

a conveyor adapted to convey the container in an upright orientation along a generally circumferential and horizontal path;

guide means extending around said conveyor and disposed so as to frictionally contact a side wall of said container sufficiently as to cause rotation of said container around its vertical axis as said container is conveyed;

a water tank in which the conveyor is at least partially water-immersed; and ultrasonic vibrators adapted to apply ultrasonic waves to the side wall of the container while the container is being rotated around its vertical axis by cooperation of said conveyor and said guide means within said water tank.

2. A container flusher as recited in claim 1, wherein the conveyor is provided at its outer peripheral surface with vertically-extending fin-like projections which are circumferentially spaced from one another at regular intervals and which projections extend vertically a distance substantially greater than a height of the container.

3. A container flusher as recited in claim 1, wherein there are provided at least partially around the conveyor upper rails and lower rails both of which are adapted to support a bottom of the container and wherein said lower rails are immersed in water within the water tank.

4. A container flusher as recited in claim 3, further comprising a sloped rail interposed between said lower and upper rails so that the container is transported along the sloped rail from said lower rail up to said upper rail.

5. A container flusher as recited in claim 3, further comprising guide means associated with the upper and lower rails, respectively.

6. A container flusher as recited in claim 3, further comprising a sloped rail interposed between said upper and lower rails so that the container is transported along the sloped rail from said upper rail down to said lower rail.

7. A container flusher as recited in claim 6, there are provided guide means associated with the upper rails, the sloped rails and the lower rails, respectively.

8. A container flusher as recited in claim 1, further comprising a nozzle provided above the conveyor so that the container is filled with flushing liquid injected through said nozzle.

9. A container flusher as recited in claim 1, further comprising a heater provided below the water tank.

10. A container cooler comprising:

a conveyor adapted to convey the container in an upright orientation, along a generally circumferential and horizontal path;

guide means extending around said conveyor and disposed so as to frictionally contact a side wall of said container sufficiently as to cause rotation of said container around its own vertical axis as said container is conveyed;

a water tank in which the conveyor is at least partially water-immersed; and a cooling unit provided within said water tank and having an inlet and an outlet for cooling water.

11. A container cooler as recited in claim 10, further comprising ultrasonic vibrators adapted to apply ultrasonic waves to the side wall of the container within said water tank.

* * * * *